United States Patent [19]

Ebner

[11] 4,119,976

[45] Oct. 10, 1978

[54] PHOTOTYPESETTER LENS CARRIAGE ARRANGEMENT

[75] Inventor: Peter R. Ebner, South Nashua, N.H.

[73] Assignee: Itek Corporation, Lexington, Mass.

[21] Appl. No.: 790,713

[22] Filed: Apr. 25, 1977

[51] Int. Cl.[2] ..... B21B 21/00

[52] U.S. Cl. ..... 354/5; 354/18

[58] Field of Search ..... 354/4, 5, 10, 18, 123; 355/53

[56] References Cited

U.S. PATENT DOCUMENTS 3,903,536 9/1975 Westerberg ..... 354/4

*Primary Examiner*—Russell E. Adams

*Attorney, Agent, or Firm*—Homer O. Blair; Robert L. Nathans

[57] ABSTRACT

A lens carriage is mounted upon a cylindrical way at a left-hand portion thereof, and is supported at a right-hand portion thereof by a single roller which rolls over a flat plate way during translation of the carriage parallel to the optical axis of the phototypesetter. A brake shoe coupled to the carriage is spring biased against the lower surface of the flat plate way, and as a result, there is no play or looseness in the arrangement and yet imprecise positioning of the way elements in space, to save manufacturing costs, results in modest and repeatable shifts of the lens element mounted upon the carriage in directions transverse to the optical axis.

20 Claims, 5 Drawing Figures

PHOTOTYPESETTER LENS CARRIAGE ARRANGEMENT

BACKGROUND OF THE INVENTION

Prior art phototypesetting machines employ slidable carriages which carry optical elements such as lenses for imaging characters upon a photosensitive medium. Required changes in magnification in turn require the shifting of the carriage positions along the optical axis (in the *z* direction) to maintain focus for all character image sizes imaged upon the photosensitive medium. It has been desirable in the design of certain of these phototypesetters to provide for shifting of the lens carriages along left-hand and right-hand rail elements or ways in a manner to maintain translation of the carriage mounted lens elements in space (in the *x* and *y* directions) at a minimum as the carriages are moved parallel to the longitudinal axis of the ways supporting the carriages. This requirement tends to conflict with the requirement that these individually actuated carriages do not bind since such binding would render the system subject to partial or total jamming. In order to accommodate these somewhat conflicting requirements, the ways supporting the carriages had to be precisely machined and precisely positioned with respect to each other, which is relatively costly. Even with such precise fabrication, a certain amount of looseness or play had to be built into the system to prevent binding of the carriages with respect to the supporting ways, the play subjecting the lens elements to random uncontrolled displacement in *x* and *y*.

It is accordingly highly desirable to provide a lens element carriage arrangement which eliminates the abovestated looseness or play and additionally, does not require precise positioning or parallelism between the two ways supporting the carriages. The elimination of the latter requirement considerably reduces manufacturing costs, by for example, permitting the ways to be affixed to a bed which need not maintain precise dimensioning and thus may be extruded rather than otherwise precision machined.

SUMMARY OF THE INVENTION

The abovestated objects have been attained in accordance with preferred embodiments of the invention by mounting the ways upon a relatively imprecise bed so that the left-hand portion of the carriage rides upon a cylindrical way and a single roller, rigidly coupled to the carriage, rides upon a flat way at the right-hand portion of the carriage so that the right-hand portion is suspended from the right-hand way. A carriage brake, also rigidly affixed to the carriage, is positioned below the right-hand way and a brake shoe is springbiased against the lower surface of the right-hand way and co-acts with the other structure to attain the abovementioned objects of the invention.

BRIEF DESCRIPTION OF THE DRAWINGS

Other objects, features and advantages of the present invention will become apparent upon the perusal of the following description taken in conjunction with the drawings in which.

DETAILED DESCRIPTION

Figure 1:
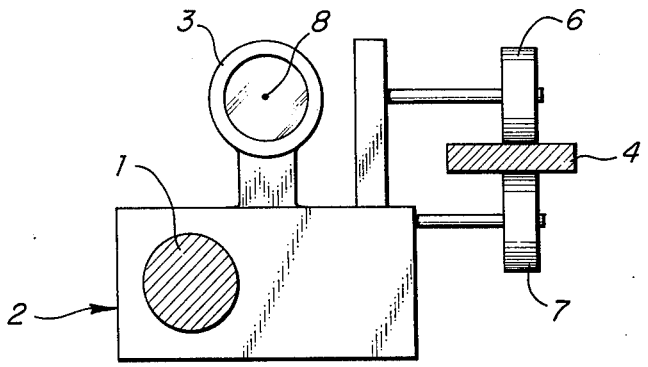
PRIOR ART FIG. 1.
FIG. 1 illustrates a prior art carriage support arrangement.

In FIG. 1, a cylindrical rail or way 1 typically supports the left-hand portion of carriage 2 which in turn supports a lens element support device 3. A conventional ball housing may be employed having balls 5 in rolling contact with the cylindrical way. The right-hand portion of carriage 2 is typically supported by a flat rectangular way 4 by means of rollers 6 and 7, rotatably coupled to carriage 2. Optical axis 8, perpendicular to the plane of the drawing, ideally coincides with the center of the lens affixed to support element 3. In order to maintain precise positioning of lens support element 3 during translation of the carriage perpendicular to the plane of the FIGURE, the center lines of rollers 6 and 7 must be separated from each other in order to accommodate the abovementioned play or looseness to prevent binding between the rollers and way 4. This is true even though ways 1 and 4 are relatively precisely positioned with respect to each other along the length of the bed in a direction parallel to the optical axis. Even with such relatively precise positioning, a limited degree of looseness between the rollers and way 4 is required (e.g. 5–10 mils) since binding would otherwise at least occasionally occur to jam the carriages as absolute precision is not attainable in practise.

Figure 2:
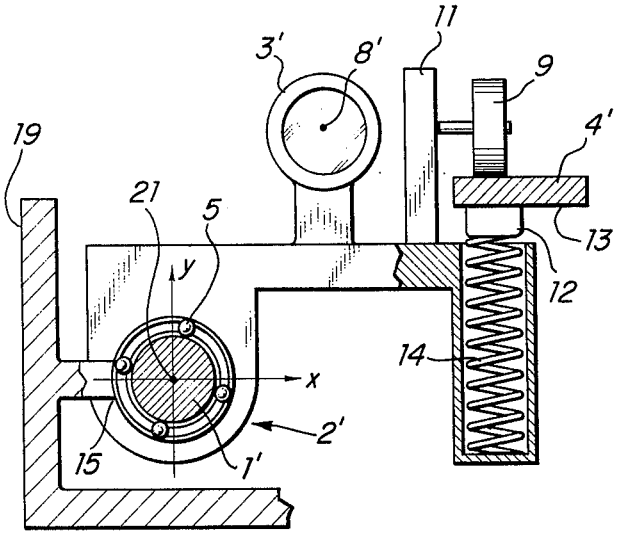
FIG. 2 illustrates a sideview of the carriage arrangement of the present invention.
Figure 3:
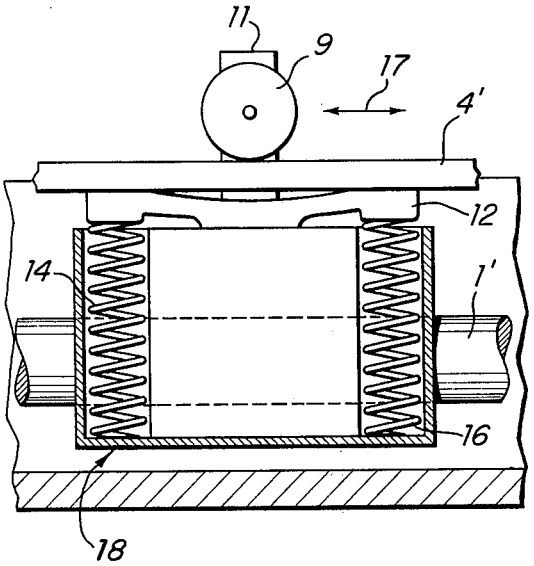
FIG. 3 illustrates a partial front view of the carriage arrangement of the present invention.

In FIG. 2 cylindrical way 1′ supports the left-hand portion of carriage 2′ whereas way 4′ supports the right-hand portion of the carriage by virtue of a single roller 9, rotatably coupled to carriage 2′ by support element 11. A lens element support member 3′ is affixed to the top of the carriage as in the case of the FIG. 1 arrangement. A contact element such as brake shoe 12 is springbiased against, and thus in contact with the lower surface 13 of way 4′ by means of springs 14 and 16 as illustrated in FIG. 3, which also illustrates roller 9 riding across the upper surface of flat way 4′ to enable Z motion of the carriage parallel to the optical axis 8′ as indicated by arrow 17. Brake 18 is employed to apply a constant braking force against which a carriage drive (which forms no part of the present invention) operates. For further details see U.S. Pat. application 652,024 filed on Jan. 26, 1976, now U.S. Pat. No. 4,067,022 in the name of Peter R. Ebner and assigned to the same assignee of the present invention. This structure (not shown) employs a carriage mounted clutch which grips a drive rod which is in turn stepped by a stepping motor.

Figure 4:
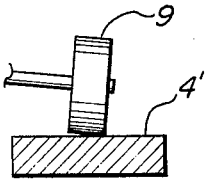
FIGS. 4 and 5 schematically illustrate the "heel and toe" roller action of the present invention.
Figure 5:
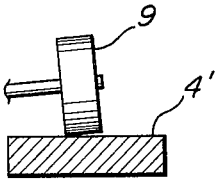

Cylindrical way 1′ is affixed at 15 to an extruded bed, a portion 19 of which is illustrated in FIG. 2. Since the inexpensive extruded bed is dimensionally sloppy, the center point 21 of cylindrical way 1′ will shift in X and/or in Y for different positions along the length of the bed parallel to the optical axis. Unlike the FIG. 1 arrangement, the system will not exhibit looseness or play normally required to prevent binding, which absence of play is important in maintaining repeatability of the positioning of the lens element in X and Y with respect to the optical axis. These objectives are accomplished since a shifting of way center point 21 upwardly in the plus Y direction will cause the surface of roller 9 to "heel" with respect to the upper surface of way 4′ as illustrated (in greatly exaggerated form) in FIG. 4. The left-hand portion of the carriage will tend to rotate about the roller-plate way interface. Looseness however, does not occur because of brake springs 14 and 16 which, besides maintaining braking action, have the dual function of eliminating such play. In contrast, as the center point 21 of cylindrical way 1' moves downwardly in the minus Y direction, roller 9 will "toe" as illustrated in exaggerated form in FIG. 5. Shifts of point 21 in the plus $x$ and minus $x$ directions are readily accommodated without play as the carriage travels in the $z$ direction (in and out of the plane of the FIGURE) since a sliding and induced rolling action occurs between the roller and the upper surface of plate way 4'. Springs 14 and 16 and internally positioned within the movable carriage as illustrated in FIGS. 3 and 4.

In summary the unique arrangement of the present invention permits relatively wide tolerances in the dimensions of the bed supporting the ways and yet provides for repeatability in the resulting induced $x$ and $y$ lens element shifts as the carriages move in $z$, which repeatable shifts are readily accounted for by the custom coding method discussed in the abovementioned patent application. Additionally, sloppiness or play which would otherwise permit randomly applied forces to shift the position of the elements in random fashion during typesetter operation have been eliminated and yet binding does not occur. It may be feasible to practise the invention by gravity biasing roller 9 against way 4' with a carriage mounted weight rather than by virtue of the reaction force of spring 14. The term roller element is intended to include ball elements or the like.

While preferred embodiments of the invention have been described, the teachings of this invention will readily suggest many other embodiments to those skilled in the art and thus the invention is to be limited only by the permissible scope of the following claims.

What is claimed is:

1. In a phototypesetter:

a. a carriage having an optical element affixed thereto for translating said optical element parallel to an optical axis;

b. a first way for slidably supporting a first portion of said carriage, said first way being oriented parallel with respect to said optical axis;

c. a second way separated from said first way for slidably supporting a second portion of said carriage, said second way being oriented parallel with respect to said optical axis;

d. carriage support means coupled to said carriage and in contact with said second way for supporting the second portion of said carriage; and e. mechanical biasing means coupled to said carriage for biasing said carriage support means against said second way to a sufficient extent to eliminate looseness between said carriage support means and said second way, thereby to maintain repeatability of the positioning of said optical element with respect to said optical axis.

2. The combination as set forth in claim 1 wherein said carriage support means includes a rolling element contacting said second way to provide for ease of translation of said carriage along the length of said second way.

3. The combination as set forth in claim 1 wherein said mechanical biasing means includes a contact element positioned in contact with said second way and spring means for pressing said contact element against said second way.

4. The combination as set forth in claim 2 wherein said mechanical biasing means includes a contact element positioned in contact with said second way and spring means for pressing said contact element against said second way.

5. The combination as set forth in claim 3 wherein said contact element is a brake shoe.

6. The combination as set forth in claim 4 wherein said contact element is a brake shoe.

7. In a phototypesetter:

a. a carriage having an optical element affixed thereto for translating said optical element parallel to an optical axis;

b. a first way for slidably supporting a first portion of said carriage, said first way being oriented parallel with respect to said optical axis;

c. a second way separated from said first way for slidably supporting a second portion of said carriage, said second way being oriented parallel with respect to said optical axis;

d. carriage support means coupled to said carriage and in contact with an upper portion of said second way for supporting the second portion of said carriage; and e. mechanical biasing means internal of said carriage for biasing said carriage support means against said second way to a sufficient extent to eliminate looseness between said carriage support means and said second way, thereby to maintain repeatability of the positioning of said optical element with respect to said optical axis.

8. The combination as set forth in claim 7 wherein said carriage support means includes a rolling element contacting said second way to provide for ease of translation of said carriage along the length of said second way.

9. The combination as set forth in claim 7 wherein said mechanical biasing means includes a contact element positioned in contact with a lower portion of said second way and spring means for pressing said contact element against said second way and for producing a reaction force for biasing said carriage support means against said upper portion of said second way.

10. The combination as set forth in claim 8 wherein said mechanical biasing means includes a contact element positioned in contact with a lower portion of said second way and spring means for pressing said contact element against said second way to produce a reaction force for biasing said carriage support means against said upper portion of said second way.

11. The combination as set forth in claim 9 wherein said contact element is a brake shoe.

12. The combination as set forth in claim 10 wherein said contact element is a brake shoe.

13. In a phototypesetter:

a. a carriage having an optical element affixed thereto for translating said optical element parallel to an optical axis;

b. a first way for slidably supporting a first portion of said carriage, said first way being oriented parallel with respect to said optical axis;

c. a second way separated from said first way and having a flat upper surface for slidably supporting a second portion of said carriage, said second way being oriented parallel with respect to said optical axis;

d. carriage support means coupled to said carriage and in contact with said flat upper surface of said second way for supporting the second portion of said carriage; and e. mechanical biasing means wholly within said carriage for biasing said carriage support means against said flat upper surface of said second way to a sufficient extent to eliminate looseness between said carriage support means and said second way, thereby to maintain repeatability of the positioning of said optical element with respect to said optical axis.

14. The combination as set forth in claim 13 wherein said carriage support means includes a rolling element contacting said flat upper surface of said second way to provide for ease of translation of said carriage along the length of said second way.

15. The combination as set forth in claim 13 wherein said mechanical biasing means includes a contact element positioned in contact with a lower surface of said second way and spring means positioned under said contact element and said second way for pressing said contact element against said lower surface of said second way.

16. The combination as set forth in claim 14 wherein said mechanical biasing means includes a contact element positioned in contact with a lower surface of said second way and spring means for pressing said contact element against said lower surface of said second way.

17. The combination as set forth in claim 15 wherein said contact element is a brake shoe.

18. The combination as set forth in claim 16 wherein said contact element is a brake shoe.

19. In a phototypesetter:

a. a carriage having an optical element affixed thereto for translating said optical element parallel to an optical axis;

b. a cylindrical way for slidably supporting a first portion of said carriage, said cylindrical way being oriented parallel with respect to said optical axis;

c. a flat plate way separated from said cylindrical way for slidably supporting a second portion of said carriage, said flat plate way being oriented parallel with respect to said optical axis;

d. a rotatable roller element;

e. means for coupling said rotatable roller element to said carriage for causing said roller element to rest upon an upper surface of said flat plate way for supporting said second portion of said carriage;

f. a contact element;

g. a spring means wholly internal of said carriage for pressing said contact element against a lower surface of said flat bed way and for producing a reaction force for pulling said roller element downwardly against the upper surface of said flat bed way.

20. The combination as set forth in claim 19 wherein said contact element is a brake shoe.

* * * * *